US005731137A

United States Patent [19]

Saito et al.

[11] Patent Number: 5,731,137

[45] Date of Patent: Mar. 24, 1998

[54] EMULSIFIED DISPERSION AND SILVER HALIDE COLOR PHOTOGRAPHIC LIGHT-SENSITIVE MATERIAL CONTAINING THE SAME

[75] Inventors: Yuko Saito; Masatoshi Nakanishi, both of Minami-ashigara, Japan

[73] Assignee: Fuji Photo Film Co., Ltd., Kanagawa, Japan

[21] Appl. No.: 698,026

[22] Filed: Aug. 15, 1996

[30] Foreign Application Priority Data

Aug. 18, 1995 [JP] Japan ..... 7-232048

[51] Int. Cl.[6] ..... G03C 1/815; G03C 7/388; G03C 11/22

[52] U.S. Cl. ..... 430/512; 430/546; 430/931; 106/498; 252/312; 252/589; 524/91

[58] Field of Search ..... 430/512, 546, 430/931; 252/589, 312; 524/91; 106/498

[56] References Cited

U.S. PATENT DOCUMENTS

| | | | |
|---|---|---|---|
| 3,253,921 | 5/1966 | Sawdey | 430/512 |
| 4,220,711 | 9/1980 | Nakamura et al. | 96/84 |
| 5,200,303 | 4/1993 | Takahashi et al. | 430/546 |
| 5,294,529 | 3/1994 | Idogaki et al. | 430/546 |
| 5,360,705 | 11/1994 | Yoneyama | 430/512 |
| 5,521,058 | 5/1996 | Yoshioka et al. | 430/546 |
| 5,543,275 | 8/1996 | Makuta | 430/512 |
| 5,585,228 | 12/1996 | Vishwakarma | 430/512 |

FOREIGN PATENT DOCUMENTS

| | | |
|---|---|---|
| 0095920 | 12/1983 | European Pat. Off. . |
| 50-140126 | 11/1975 | Japan . |
| 51-26035 | 3/1976 | Japan . |
| 62-75441 | 4/1987 | Japan . |
| 2163737 | 6/1990 | Japan . |

*Primary Examiner*—Richard L. Schilling
*Attorney, Agent, or Firm*—Sughrue, Mion, Zinn, Macpeak & Seas, PLLC

[57] ABSTRACT

There is disclosed an emulsified dispersion, in which at least one compound of the formula (1) dissolved in an organic solvent comprising at least one high-boiling organic solvent satisfying the condition X≧85 in formula (A) is emulsified in a water medium; with the proviso that phthalates and compounds having an epoxy group and having the viscosity less than 100 mPas are excluded from said high-boiling organic solvents: formula (1)

wherein $R^1$, $R^2$, $R^3$, $R^4$, $R^5$, and $R^6$, which are the same or different, each represent a hydrogen atom or a substituent, and $R^5$ and $R^6$ may bond together to form a 6-membered ring, formula (A)

$$X=24.7\times Log_{10}Y-11.7\times Z+43.7$$

wherein Y and Z stand for, respectively, the viscosity in mPas at 25° C. and the specific water content in % by weight of the high-boiling organic solvent. There is also disclosed a silver halide color light-sensitive material containing the emulsified dispersion. In the emulsified dispersion by using an ultraviolet absorbing agent, the long-term dispersion stability of the emulsion is excellent and the decomposition of the ultraviolet absorbing agent with light is prevented, without involving such a problem as defective coating. Further, in the light-sensitive material, the color fading of the dye images is obviated.

14 Claims, No Drawings

EMULSIFIED DISPERSION AND SILVER HALIDE COLOR PHOTOGRAPHIC LIGHT-SENSITIVE MATERIAL CONTAINING THE SAME

FIELD OF THE INVENTION

The present invention relates to an emulsified dispersion and a silver halide color photographic light-sensitive material containing the same. More particularly, the present invention relates to a silver halide color photographic light-sensitive material improved in light resistance by using an ultraviolet absorbing agent, which material is therefore improved in light fastness of the dye images and excellent in dispersion stability.

BACKGROUND OF THE INVENTION

In silver halide color light-sensitive materials, it is desired that the dye images formed by reaction of the oxidation product of an aromatic primary amine developing agent with the couplers do not cause any color fading (discoloration) even when exposed to light for a long time.

Therefore, in recent years, although an ultraviolet absorbing agent is added into a layer of the light-sensitive materials, particularly in order to improve the fastness of the dye images to light, the light fastness of the image dyes formed from yellow, magenta, and cyan couplers is still not satisfactory. As means of improving this, a method of preventing denaturing or disappearing of an ultraviolet absorbing agent, by dissolving the ultraviolet absorbing agent in a high-boiling organic solvent, selected from phosphates or phthalates, is suggested in JP-A ("JP-A" means unexamined published Japanese patent application) No. 209735/1983, but the effect is unsatisfactory.

As other means of improving the light fastness of image dyes, a combination of a benzophenone ultraviolet-absorbing agent with a benzotriazole ultraviolet-absorbing agent is suggested in JP-B ("JP-B" means examined Japanese patent publication) Nos. 31255/1973 and 30493/1973.

However, the light fastness is unsatisfactory because of decomposition of the ultraviolet absorbing agent itself with exposure to light.

As other means, a method wherein a polymer latex impregnated with an ultraviolet absorbing agent is disclosed in British Patent No. 2,016,017A, but this method suffers from the defect that a large amount of a polymer latex including an ultraviolet absorbing agent has to be used in order to satisfactorily improve the light fastness.

Further, although a method in which an ultraviolet absorber polymer latex is used is disclosed in JP-A No. 185677/1983, the method only prevents to a small degree yellow stain that will be produced on the white background by irradiation with light. On the other hand, a method of improving the light fastness of an ultraviolet absorbing agent itself and dye images, by emulsifying and dispersing the ultraviolet absorbing agent together with a specific hydrophobic polymer is described in JP-A No. 264748/1988. However, in putting the above method into practice, the following problems were found. That is, a large amount of a polymer has to be added for the ultraviolet absorbing agent in order to satisfactorily improve the light fastness of the ultraviolet absorbing agent. As a result, it takes a long period of time to dissolve, and further, since the mixed solution has a high viscosity, the emulsification and dispersion are difficult to carry out and coarse particles are readily formed, which causes the coating to be defective.

On the other hand, as a method of improving long-term dispersion stability of an emulsion, a technique is developed in which two or more ultraviolet absorbing agents are used in combination, to increase the solubility by the depression of melting point of the ultraviolet absorbing agents, which technique is described, for example, in JP-B Nos. 5496/1973, 30493/1973, and 41572/1973 and JP-A Nos. 85425/1978, 215378/1984, and 1748/1992, but the effect is unsatisfactory.

SUMMARY OF THE INVENTION

Therefore, an object of the present invention is to provide an emulsified dispersion of an ultraviolet absorbing agent, in which dispersion the long-term dispersion stability of the emulsion is excellent and the decomposition of the ultraviolet absorbing agent with light is prevented, without involving such a problem as defective coating.

Another object of the present invention is to provide a silver halide color photographic light-sensitive material, the color fading of the dye images of which is obviated by using the foregoing emulsified dispersion.

Other and further objects, features, and advantages of the invention will appear more fully from the following description.

DETAILED DESCRIPTION OF THE INVENTION

The present inventors have found that the above objects can be attained by the following emulsified dispersions (1) to (4) and the following silver halide color photographic light-sensitive material (5):

(1) An emulsified dispersion, in which at least one compound represented by the formula (1) dissolved in an organic solvent comprising at least one high-boiling organic solvent satisfying the condition $X \geqq 85$ in the formula (A) is emulsified in a water medium; with the proviso that phthalates and compounds having an epoxy group are excluded from said high-boiling organic solvents:

formula (1)

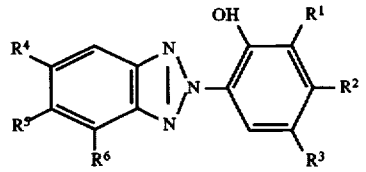

wherein $R^1$, $R^2$, $R^3$, $R^4$, $R^5$, and $R^6$, which are the same or different, each represent a hydrogen atom, a halogen atom, a nitro group, a hydroxyl group, an alkyl group, an alkoxy group, an aryl group, an aryloxy group, an acylamino group, a carbamoyl group, or a sulfo group, and $R^5$ and $R^6$ may bond together to form a 6-membered ring, formula (A)

$$X=24.7\times Log_{10}Y-11.7\times Z+43.7$$

wherein Y and Z stand for, respectively, the viscosity of the high-boiling organic solvent in mPas at 25° C., and the specific water content of the high-boiling organic solvent in % by weight.

(2) The emulsified dispersion as stated in the above (1), wherein the viscosity of the said high-boiling organic solvent at 25° C. is 100 mPas or more but 6,000 mPas or less.

(3) The emulsified dispersion as stated in the above (1), wherein the said high-boiling organic solvent is selected from the following:

[1] phosphates represented by the formula (2):

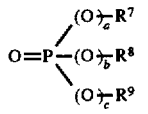

formula (2)

wherein $R^7$, $R^8$, and $R^9$ each independently represent an aliphatic group or an aryl group, and a, b, and c are each independently 0 or 1,

[2] trimellitates represented by the formula

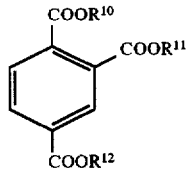

wherein $R^{10}$, $R^{11}$, and $R^{12}$ each independently represent an aliphatic group or an aryl group,

[3] aliphatic acid esters represented by the formula (4): formula (4)

$$R^{13}COOR^{14}$$

wherein $R^{13}$ represents a hydrogen atom or an aliphatic group, and $R^{14}$ represents an aliphatic group or an aryl group, and

[4] chlorinated paraffins represented by the formula (5): formula (5)

$$C_dH_{(2d-e+2)}Cl_e$$

wherein d and e are each a positive integer with $e \leqq 2d+2$.

(4) The emulsified dispersion as stated in the above (3), wherein the said high-boiling organic solvent is the trimellitate represented by formula (3), and wherein $R^{10}$, $R^{11}$, and $R^{12}$ each represent an alkyl group, and the total number of carbon atoms in the alkyl moieties is 24 to 36.

(5) An emulsified dispersion, in which at least one compound represented by formula (1) in the above (1) dissolved in an organic solvent comprising at least one high-boiling organic solvent satisfying the condition $X \geqq 85$ in formula (A) in the above (1), having a viscosity of 100 mPas or more but 6,000 mPas or less at 25° C., and possessing an epoxy group, is emulsified in a water medium.

(6) A silver halide color photographic light-sensitive material, which contains, in at least one layer of light-sensitive silver halide emulsion layer and non-light-sensitive hydrophilic colloid layer applied on a base, at least one compound represented by formula (1) in the above (1) and at least one high-boiling organic solvent satisfying the condition $X \geqq 85$ in formula (A) in the above (1); with the proviso that phthalates and compounds having an epoxy group are excluded from said high-boiling organic solvent.

(7) A silver halide color photographic light-sensitive material, which contains, in at least one layer of light-sensitive silver halide emulsion layer and non-light-sensitive hydrophilic colloid layer applied on a base, at least one compound represented by formula (1) in the above (1) and at least one high-boiling organic solvent satisfying the condition $X \geqq 85$ in formula (A) in the above (1), having a viscosity of 100 mPas or more but 6,000 mPas or less at 25° C. and possessing an epoxy group.

PREFERRED EMBODIMENT OF THE INVENTION

In the present invention, preferably the layer containing the emulsified dispersion stated in the above (1), (2), (3), (4), and (5) is the non-light-sensitive hydrophilic colloid layer, and more preferably the layer containing the said emulsified dispersion comprises one or more light-sensitive silver halide emulsion layers and one or more non-light-sensitive hydrophilic colloid layers. Further more preferably the said light-sensitive layer and/or the said non-light-sensitive hydrophilic colloid layer contains the said emulsified dispersion in the form of fine droplets. Further, it is possible that the compound represented by formula (1) is dissolved in a conventional organic solvent, with the resulting solution emulsified and dispersed in an aqueous solution; and the resulting emulsified dispersion, and the emulsified dispersion prepared by emulsifying and dispersing the above high-boiling organic solvent according to the present invention in an aqueous solution, are added as a mixture or separately to a coating liquid for a silver halide emulsion layer or a light-nonsensitive hydorphilic colloid layer.

The specific constituent of the present invention is described below in more detail.

Parts of specific examples of the compounds represented by formula (1) are shown in Table 1, but the present invention is not limited to them.

TABLE 1

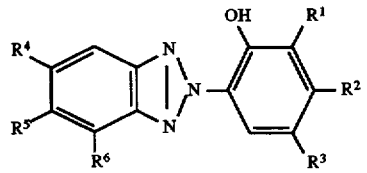

| | (1-a) ($R^6$ = H) | | | | |
|---|---|---|---|---|---|
| U V No. | $R^4$ | $R^5$ | $R^2$ | $R^1$ | $R^3$ |
| 1 | H | H | H | H | H |
| 2 | H | H | H | H | $CH_3$ |
| 3 | H | H | H | H | t-$C_4H_9$ |
| 4 | H | H | H | H | s-$C_5H_{11}$ |
| 5 | H | H | H | H | t-$C_5H_{11}$ |

TABLE 1-continued

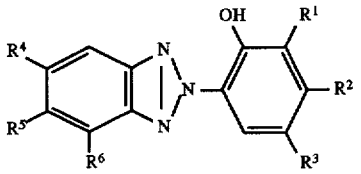

| | | | | | |
|---|---|---|---|---|---|
| 6 | H | H | H | H | 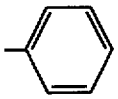 |
| 7 | H | H | H | H | $C_6H_{11}$ |
| 8 | H | H | H | H | n-$C_8H_{17}$ |
| 9 | H | H | H | H | i-$C_8H_{17}$ |
| 10 | H | H | H | H | t-$C_8H_{17}$ |
| 11 | H | H | H | H | n-$C_{12}H_{25}$ |
| 12 | H | H | H | H | n-$C_{16}H_{33}$ |
| 13 | H | H | H | H | $OCH_3$ |
| 14 | H | H | H | H | $C_2H_4COOC_8H_{17-n}$ |
| 15 | H | H | H | H | $CONHC_{12}H_{25-n}$ |
| 16 | H | H | H | $CH_3$ | s-$C_4H_9$ |
| 17 | H | H | H | $CH_3$ | t-$C_4H_9$ |
| 18 | H | H | H | $CH_3$ | iso-$C_{12}H_{25}$ |
| 19 | H | H | H | s-$C_4H_9$ | t-$C_4H_9$ |
| 20 | H | H | H | t-$C_4H_9$ | s-$C_4H_9$ |
| 21 | H | H | H | t-$C_4H_9$ | t-$C_4H_9$ |
| 22 | H | H | H | t-$C_4H_9$ | s-$C_{12}H_{25}$ |
| 23 | H | H | H | t-$C_4H_9$ | $C_2H_4COOC_8H_{17-n}$ |
| 24 | H | H | H | t-$C_5H_{11}$ | t-$C_5H_{11}$ |
| 25 | H | H | H | t-$C_5H_{11}$ | $C_6H_5$ |
| 26 | H | H | H | t-$C_5H_{11}$ | $CH_2$ 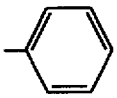 |
| 27 | H | H | H | Cl | Cl |
| 28 | H | H | H | $CH_2NHCOOC_5H_{11-n}$ | H |
| 29 | H | Cl | H | H | t-$C_5H_{11}$ |
| 30 | H | Cl | H | H | 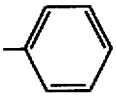 |
| 31 | H | Cl | H | H | $C_6H_{11}$ (cycl.) |
| 32 | H | Cl | H | H | $C_2H_4COOC_8H_{17}$ (i + sec) |
| 33 | H | Cl | H | H | Cl |
| 34 | H | Cl | H | s-$C_4H_9$ | s-$C_4H_9$ |
| 35 | H | Cl | H | s-$C_4H_9$ | t-$C_4H_9$ |
| 36 | H | Cl | H | t-$C_4H_9$ | $CH_3$ |
| 37 | H | Cl | H | t-$C_4H_9$ | $CH_2CH{=}CH_2$ |
| 38 | H | Cl | H | t-$C_4H_9$ | s-$C_4H_9$ |
| 39 | H | Cl | H | t-$C_4H_9$ | t-$C_4H_9$ |
| 40 | H | Cl | H | t-$C_4H_9$ | $C_6H_{11}$ (cycl.) |
| 41 | H | Cl | H | t-$C_4H_9$ | $C_2H_4COOC_8H_{17}$ |
| 42 | H | Cl | H | n-$C_5H_{11}$ | 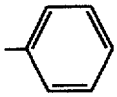 |
| 43 | H | Cl | H | $CH_2N(C_4H_{9-t})(CH_3)$ | H |
| 44 | H | $SOOC_2H_5$ | H | $CH_3$ | $CH_3$ |
| 45 | H | $CH_3$ | H | H | i-$C_8H_{17}$ |
| 46 | H | $CH_3$ | H | H | $OCH_3$ |
| 47 | H | $CH_3$ | H | s-$C_4H_9$ | s-$C_4H_9$ |
| 48 | H | $CH_3$ | H | s-$C_4H_9$ | t-$C_4H_9$ |

TABLE 1-continued

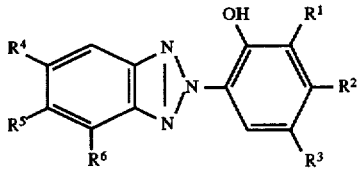

| | | | | | |
|---|---|---|---|---|---|
| 49 | H | $CH_3$ | H | t-$C_5H_{11}$ | 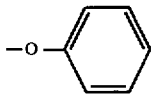 |
| 50 | H | $CH_3$ | H | Cl | n-$C_8H_{17}$ |
| 51 | H | $C_2H_5$ | H | i-$C_3H_7$ | i-$C_3H_7$ |
| 52 | H | n-$C_4H_9$ | H | s-$C_4H_9$ | s-$C_4H_9$ |
| 53 | H | n-$C_4H_9$ | H | s-$C_4H_9$ | t-$C_4H_9$ |
| 54 | H | n-$C_4H_9$ | H | s-$C_4H_9$ | t-$C_5H_{11}$ |
| 55 | H | s-$C_4H_9$ | H | t-$C_4H_9$ | t-$C_4H_9$ |
| 56 | H | s-$C_4H_9$ | H | t-$C_4H_9$ | t-$C_5H_{11}$ |
| 57 | H | s-$C_4H_9$ | H | t-$C_4H_9$ | $C_2H_4COOC_8H_{17-n}$ |
| 58 | H | s-$C_4H_9$ | H | t-$C_5H_{11}$ | t-$C_5H_{11}$ |
| 59 | H | t-$C_4H_9$ | H | s-$C_4H_9$ | s-$C_4H_9$ |
| 60 | H | t-$C_4H_9$ | H | s-$C_4H_9$ | t-$C_4H_9$ |
| 61 | H | t-$C_4H_9$ | H | s-$C_4H_9$ | t-$C_5H_{11}$ |
| 62 | H | t-$C_4H_9$ | H | t-$C_4H_9$ | t-$C_4H_9$ |
| 63 | H | n-$C_5H_{11}$ | H | s-$C_4H_9$ | t-$C_4H_9$ |
| 64 | H | t-$C_5H_{11}$ | H | s-$C_4H_9$ | t-$C_4H_9$ |
| 65 | H | t-$C_5H_{11}$ | H | t-$C_5H_{11}$ | t-$C_5H_{11}$ |
| 66 | H | $C_6H_5$ | H | t-$C_4H_9$ | t-$C_4H_9$ |
| 67 | H | $C_6H_5$ | H | t-$C_5H_{11}$ | t-$C_5H_{11}$ |
| 68 | H | n-$C_8H_{17}$ | H | H | i-$C_8H_{17}$ |
| 69 | H | OH | H | t-$C_4H_9$ | t-$C_4H_9$ |
| 70 | H | $OCH_3$ | H | H | $OC_8H_{17-n}$ |
| 71 | H | $OCH_3$ | H | s-$C_4H_9$ | s-$C_4H_9$ |
| 72 | H | $OCH_3$ | H | s-$C_4H_9$ | t-$C_4H_9$ |
| 73 | H | $OCH_3$ | H | t-$C_5H_{11}$ | t-$C_5H_{11}$ |
| 74 | H | $OCH_3$ | H | t-$C_5H_{11}$ | 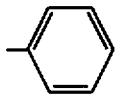 |
| 75 | H | $OCH_3$ | H | Cl | Cl |
| 76 | H | $OC_2H_5$ | H | s-$C_4H_9$ | t-$C_4H_9$ |
| 77 | H | $OC_4H_{9-n}$ | H | Cl | $OCH_3$ |
| 78 | H | 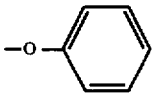 | H | t-$C_5H_{11}$ | t-$C_5H_{11}$ |
| 79 | H | $COOC_4H_{9-n}$ | H | n-$C_4H_9$ | t-$C_5H_{11}$ |
| 80 | H | $NO_2$ | H | n-$C_8H_{17}$ | $OCH_3$ |
| 81 | H | H | Cl | H | Cl |
| 82 | H | H | $OC_8H_{17-n}$ | H | H |
| 83 | H | $CH_3$ | $CH_3$ | H | $CH_3$ |
| 84 | H | Cl | n-$C_{15}H_{31}$ | H | H |
| 85 | $CH_3$ | $OC_4H_{9-n}$ | H | H | H |
| 86 | $CH_3$ | $OC_9H_{19-n}$ | H | H | H |
| 87 | $CH_3$ | $OC_{12}H_{25-n}$ | H | H | H |
| 88 | Cl | Cl | H | H | H |
| 89 | $OCH(CH_3)_2$ | " | H | H | H |
| 90 | $OCH(CH_3)_2$ | Cl | H | H | $CH_3$ |
| 91 | $OCH(CH_3)_2$ | $OC_2H_3(CH_3)_2$ | H | H | H |
| 92 | $OC_4H_{9-n}$ | $OC_4H_{9-n}$ | H | H | H |
| 93 | $OC_4H_{9-n}$ | $OC_4H_{9-n}$ | H | H | $OCH_3$ |

(1-b) ($R^2$ = H; and $R^5$ and $R^6$ bond together to form a benzen ring.)

| | $R^4$ | $R^1$ | $R^3$ |
|---|---|---|---|
| 94 | H | H | $CH_3$ |
| 95 | H | H | t-$C_8H_{17}$ |
| 96 | H | t-$C_4H_9$ | t-$C_4H_9$ |
| 97 | Cl | H | $C_2H_5$ |

When the residual ratios of the compounds (ultraviolet-absorbing agent) represented by formula (1), obtained according to a forced test with respect to light stability, were subjected to multivariate analysis for the viscosities and specific water contents of the high-boiling organic solvent, they were in good conformity with the value of X of formula (A) as shown in the Examples. When the value of X is 85 or more, the color fading (discoloration) of the dye image is at a level free from practical problems. The high-boiling organic solvents that satisfy the condition wherein the value of X is 85 or more, can be any, as long as they do not cause any problem in photographic performance. Such high-boiling organic solvents may be used alone or as a mixture of several components, such as isomers. If the high-boiling organic solvents are used as a mixture, the structural formula is expressed by average of its composition. For the high-boiling organic solvent used in the present invention, the value of X in formula (A) is preferably 90 or more, and more preferably 95 or more. There is no particular upper limit of X, but preferably X is 160 or less.

The high-boiling organic solvent is preferably a compound having a melting point of 100° C. or below and a boiling point of 140° C. or above, and it may be a liquid or a solid at room temperature. A more preferable high-boiling organic solvent is one having a melting point of 80° C. or below and a boiling point of 160° C. or more (more preferably 170° C. or more). A more preferable high-boiling organic solvent has a viscosity of 100 mPas or more but 6,000 mPas or less at 25° C. A further preferable high-boiling organic solvent has a viscosity of 200 mPas or more but 4,000 mPas or less at 25° C. The specific water content of the high-boiling organic solvent is preferably 3% by weight or less, more preferably 1% by weight or less.

Herein the viscosity of the high-boiling organic solvent was measured by using a Brookfield viscometer (manufactured by Tokyo-keiki Co.) at 25° C. and 55% RH. When the high-boiling organic solvent became a solid at 25° C., the viscosity was measured while the solvent was being gradually cooled from 120° C., and the value extrapolated to 25° C. by using Andrade's viscosity formula, was designated as the viscosity.

The specific water content of the high-boiling organic solvent was evaluated as follows: 50 ml of deionized water was added to 50 ml of the solvent; they were mixed for 15 min using an ultrasonic cell homogenizer (Powersonic 50 type, trade name, manufactured by Yamato Kagaku Co.), and then they were allowed to stand for 12 hours or more. Then the solvent was taken out, and the water content in % by weight in unit weight of the solvent was evaluated by Karl Fischer's method. When the solvent and the water could not be separated by the above method, the mixture was processed using a centrifugal separator (CR7B3 type, trade name, manufactured by Hitachi Koki Co. Ltd.) for 30 min at a centrifugal acceleration of 8,000 G, and then the solvent was taken out. When the high-boiling organic solvent became a solid at room temperature, the high-boiling organic solvent was dissolved in the same volume of hexane, and the specific water content was measured by the above method by letting the specific water content of the hexane serve as a blank.

The value of the melting point of the high-boiling organic solvent that was solid state at room temperature was measured by using a melting point apparatus (510-type melting point apparatus, manufactured by Büchi Co.).

Further, more preferably high-boiling organic solvents are selected from those shown below:

[1] phosphates represented by the formula (2)

[2] trimellitates represented by the formula (3)

[3] aliphatic acid esters represented by the formula (4)

[4] chlorinated paraffins represented by the formula (5)

If $R^7$ to $R^{14}$ in formulae (2) to (4) are aliphatic groups or groups having aliphatic groups, the aliphatic groups may be straight-chain, branched-chain, or cyclic aliphatic groups and may contain an unsaturated bond or an ether linkage. Examples of the substituent are a halogen atom, an aryl group, an alkoxy group, an aryloxy group, an alkoxycarbonyl group, a hydroxyl group, and an acyloxy group.

If $R^7$ to $R^{14}$ in formulas (2) to (4) are cycloaliphatic groups, i.e. cycloalkyl groups, or groups containing cycloalkyl groups, the cycloalkyl group may contain an unsaturated bond in a 3- to 8-membered ring and may have a substituent or a bridging group. Examples of the substituent are a halogen atom, an aliphatic group, a hydroxyl group, an acyl group, an aryl group, an alkoxy group, an epoxy group, an alkyl group, and an ether group, and examples of the bridging group are methylene, ethylene, and isopropyridene.

Out of these, trimellitates are most preferable as the high-boiling organic solvent according to the present invention, and particularly trimellitates, whose total number of carbon atoms in its alkyl moieties is 24 to 36, are preferable.

Further, when the high-boiling organic solvent was a compound having an epoxy group, as shown in the following Examples, the long-term dispersion stability of the emulsified dispersion and the light-fastness of the color image are excellent, as long as X≧85 or more in formula (A) and the viscosity at 25° C. being 100 mPas or more but 6,000 mPas or less.

Typical examples of the high-boiling organic solvent according to the present invention are shown below, but the present invention is not limited to them.

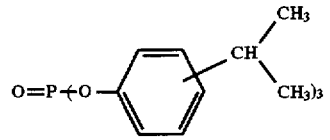

(Solv-1)

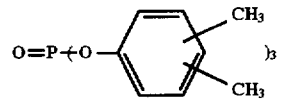

(Solv-2)

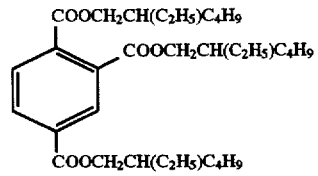

(Solv-3)

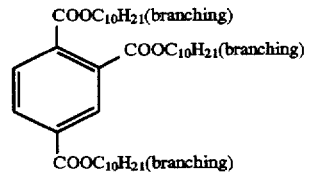

(Solv-4)

$C_{10}H_{21}$(branching) represents a mixture of branched alkyl groups having 10 carbon atoms, in a concrete, it represents a mixture of tetramethyl-1-hexyl, ethyldimethyl-1-hexyl, trimethyl-1-heptyl, dimethyl-1-octyl, methyl-1-nonyl, etc.

-continued

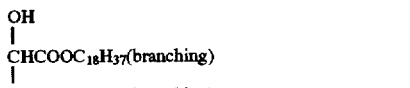

(Solv-5)

$C_{18}H_{37}$(branching) represents a 2-(1,3,3-trimethylbutyl)-5,7,7-trimethyl-1-octyl group.

(Solv-6)

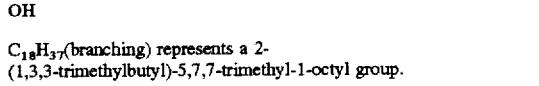

(Solv-7)

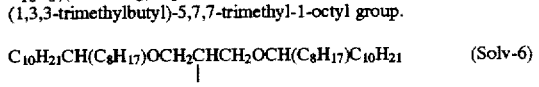

(Solv-8)

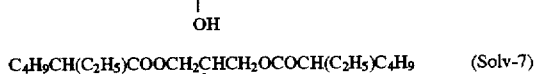

(Solv-9)

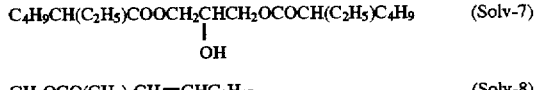

(Solv-10)

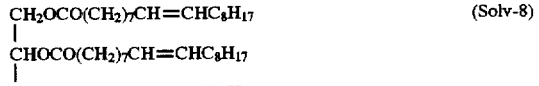

(Solv-11)

$C_{17}H_{35}$(branching) represents a 1-(1,3,3-trimethylbutyl)-4,6,6-trimethyl-1-heptyl group.

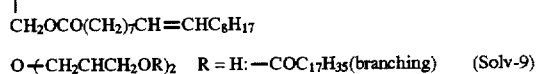

(Solv-12)

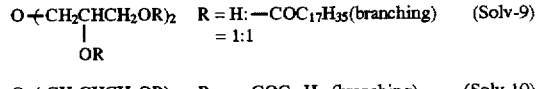

(Solv-13)

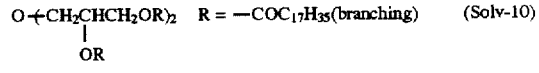

(Solv-14)

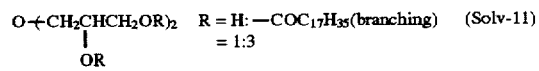

(Solv-15)

Further, there is no limitation on the amount of the high-boiling organic solvent to be used that satisfies the condition X≧85 in formula (A), and preferably the amount of the high-boiling organic solvent to be used is in the range of from 0.1 to 10, more preferably from 0.1 to 2, and further more preferably from 0.1 to 0.7, by weight ratio to the compound represented by formula (1).

The high-boiling organic solvent according to the present invention (e.g. Solv-3 and -4) not only serves as a dispersion medium (solvent) of the ultraviolet absorbing agent, it can also be used as a dispersion medium of yellow couplers, magenta couplers, and cyan couplers. If the high-boiling organic solvent according to the present invention is used as a dispersion medium of couplers, effects of improving stability (e.g. particle diameter stability and separation resistance) of the emulsion, and of improving the image fastness (e.g. of improving prevention of stain and of making the color image fast), can be obtained.

One method of preparing the dispersion containing a compound represented by formula (1) and a high-boiling organic solvent that satisfies the condition X≧85 in formula (A) according to the present invention is carried out in such a manner that the compound represented by formula (1) is completely dissolved in the high-boiling organic solvent, and then the solution is dispersed as fine droplets in water (water medium), preferably in an aqueous hydrophilic colloid solution, and more preferably in an aqueous gelatin solution with the aid of a dispersant, by using, for example, ultrasonics, a colloid mill, or a high-speed stirring machine. Alternatively, the method may be carried out in such a manner that a dispersing aid, such as a surface-active agent, and a compound represented by formula (1) are completely dissolved in a high-boiling organic solvent, and to the solution is added water or an aqueous hydrophilic colloid solution, such as an aqueous gelatin solution, so that an oil-in-water dispersion may be obtained with phase inversion.

In the emulsified dispersion of the present invention, there are no particular restrictions on the weight ratio of the oil component to the water component, generally the weight ratio is from 2 to 1/100, preferably from 2 to 1/50, and more preferably from 1 to 1/10.

To prepare the emulsion of the present invention, conventionally known surface-active agents can be used. As the surface-active agents, synthetic and natural surface-active agents, including anionic, cationic, betaine-type, and non-ionic surface-active agents, can be used.

Specifically, for example, compounds W-1 to W-99, mentioned on pages 203 to 210 of JP-A No. 215272/1987, and compounds represented by W-100, shown below, are used. In particular, W-7, W-47, and W-100 are preferred.

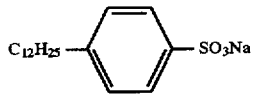

(W-7)

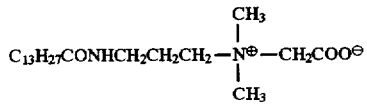

(W-47)

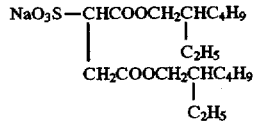

(W-100)

In preparing these dispersions, an auxiliary solvent may be used. From the thus-prepared dispersion, the organic auxiliary solvent may be removed, for example, by distillation, noodle washing, ultrafiltration, or vacuum degassing. Herein, the term "an auxiliary organic solvent" means an organic solvent useful in emulsifying and dispersing, which can finally be removed substantially from the light-sensitive material, for example, in the drying step at the time of coating, and it is a low-boiling organic solvent or a solvent that has a certain degree of solubility in water and that can be removed, for example, by washing with water. Example auxiliary organic solvents are a lower alcohol acetate, such as ethyl acetate and butyl acetate, ethyl propionate, secondary butyl alcohol, methyl ethyl ketone, methyl isobutyl ketone, β-ethoxyethyl acetate, methyl cellosolve acetate, and cyclohexanone.

Further, if necessary, an organic solvent completely compatible with water, such as methyl alcohol, ethyl alcohol, acetone, and tetrahydrofuran, can be partially used additionally.

These organic solvents can be used in combination of two or more.

Preferably the average particle diameter of the lipophilic fine particles of the thus-obtained ultraviolet absorbing agent is 0.04 to 2 μm, more preferably 0.04 to 0.4 μm, and further more preferably 0.04 to 0.20 μm. The particle diameter of the lipophilic fine particles can be measured, for example, by a measuring apparatus, such as a Nanosizer, trade name, manufactured by British Coulter Co.

The emulsified dispersion of the present invention is used in various applications as an ultraviolet-absorbing agent composition wherein the properties of the compound represented by formula (1) are exhibited usefully, and its application is not limited, but preferably it is used for photographic light-sensitive materials.

Various hydrophobic substances for photography may be incorporated into the lipophilic fine particles of the emulsified dispersion of the present invention. Examples of the hydrophobic substances for photography are dye-forming couplers, or non-dye-forming couplers, developers, developer precursors, development inhibitor precursors, development accelerators; gradation adjustors, such as hydroquinones; dyes, dye releasers, antioxidants, fluorescent whitening agents, and anti-fading agents, which may be used in combination.

The emulsified dispersion of the ultraviolet-absorbing agent of the present invention can be incorporated into the light-sensitive silver halide emulsion layer and/or the non-light-sensitive hydrophilic colloid layer by a usual method.

The total coating amount of the ultraviolet absorbing agent used in the present invention is preferably 0.1 to 10.0 $g/m^2$, more preferably 0.1 to 5.0 $g/m^2$.

Silver chloride, silver bromide, silver (iodo) chlorobromide, silver iodobromide, and the like can be used as a silver halide used in the present invention, and particularly for rapid processing, preferably use is made of a silver chloride emulsion or silver chlorobromide emulsion substantially free from silver iodide and having a silver chloride content of 90 mol % or more, more preferably 95 mol % or more, and particularly preferably 98 mol % or more. The expression "substantially free from silver iodide" means that the silver iodide content is 1 mol % or less, and preferably the silver halide does not contain silver iodide at all.

For the purpose of improving, for example, sharpness of the image, in the light-sensitive material according to the present invention, dyes described on pages 27 to 76 of European Patent EP No. 0,337,490A2, which can be deprived of color by processing (in particular oxonol dyes), can be added to the hydrophilic colloid layer, so that the optical reflection density of the light-sensitive material at 680 nm may be 0.70 or more; or, preferably 12% by weight or more (more preferably 14% by weight or more) of titanium oxide, whose surface has been treated with bivalent to tetravalent alcohols (e.g. Trimethylolethane) or the like, is contained in the water-resistant resin layer in the base.

Further, in the light-sensitive material according to the present invention, preferably use is made of a dye-image-preservability-improving compound, as described in European Patent EP No. 0,277,589A2, together with a coupler. Particularly preferably such a compound is used together with a pyrazoloazole coupler or a pyrrolotriazole coupler.

That is, preferably compounds that will combine chemically with the aromatic amine developing agent remaining after color development processing, to produce a chemically inert and substantially colorless compound, and/or compounds that will combine chemically with the oxidation product of the aromatic amine developing agent remaining after color development processing, to produce a chemically inert and substantially colorless compound, are used in combination or alone. This is because, by using these compounds, for example, occurrence of stain or other side effects, due to the production of a color-formed dye resulting from reaction of the coupler with the color developing agent or its oxidation product remaining in the film during storage after the processing, can be prevented.

Further, into the light-sensitive material according to the present invention, preferably a mildewcide, as described in JP-A No. 271247/1988, is added in order to prevent various mildews and fungi that will propagate in the hydrophilic colloid layer, to deteriorate the image.

As the base to be used in the light-sensitive material according to the present invention, a white polyester base for display, or a base having a layer containing a white pigment on the side having the silver halide emulsion layer, may be used. Further, in order to improve the sharpness, preferably an antihalation layer is applied to the base on the side where the silver halide emulsion layer is applied, or to the back surface of the base. Further, preferably the transparency temperature of the base is set in the range of 0.35 to 0.8, so that the display can be appreciated by reflected light or transmitted light.

The light-sensitive material according to the present invention may be exposed to visible light or infrared light. As the exposure method, low-intensity exposure and high-intensity, short-period exposure can be used, and in the latter case a laser scanning exposure system, with the exposure time being $10^{-4}$ or less per picture element, is preferable.

In the exposure, a band stop filter, described in U.S. Pat. No. 4,880,726, is preferably used. This removes the light fading, and the color reproduction is remarkably improved.

Preferably the light-sensitive material that has been exposed to light is bleach-fixed after the color development, for the purpose of rapid processing. Particularly when the above high-silver-chloride-content emulsion is used, the pH of the bleach-fix solution is preferably about 6.5 or below, more preferably about 6 or below, for example, for the purpose of accelerating desilvering.

As the silver halide emulsions, other materials (e.g. additives), and photographic constitutional layers (e.g. layer arrangement) that can be applied to the light-sensitive material according to the present invention; and, as the processing methods and the processing additives that can be applied for processing the light-sensitive material, those described in the below-mentioned patent gazettes, in particular European Patent EP No. 0,355,650A2, are preferably used.

| Photographic constituting element, etc. | JP-A No. 215272/1987 | JP-A No. 33144/1990 | EP 0,355,660A2 |
|---|---|---|---|
| Silver halide emulsion | p. 10 upper right column line 6 to p. 12 lower left column line 5, and p. 12 lower right column line 4 from the bottom to p. 13 upper left column line 17 | p. 28 upper right column line 16 to p. 29 lower right column line 11 and p. 30 lines 2 to 5 | p. 45 line 53 to p. 47 line 3 and p. 47 lines 20 to 22 |
| Solvent for silver halide | p. 12 lower left column line 6 to 14 and p. 13 upper left column line 3 from the bottom to p. 18 lower left column last line | — | — |

-continued

| Photographic constituting element, etc. | JP-A No. 215272/1987 | JP-A No. 33144/1990 | EP 0,355,660A2 |
|---|---|---|---|
| Chemical sensitizer | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing agent (method) | p. 22 upper right column line 8 from the bottom to p. 38 last line | p. 30 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magenta, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to p. 63 line 50 |
| Color Formation-strengthening agent | p. 121 upper left column line 7 to p. 125 upper right column line 1 | — | — |
| Ultraviolet absorbing agent | p. 125 upper right column line 2 to p. 127 lower left column last line | p. 37 lower right column line 14 to p. 38 upper left column line 11 | p. 65 lines 22 to 31 |
| Discoloration inhibitor (Image stabilizer) | p. 127 lower right column line 1 to p. 137 lower left column line 8 | p. 36 upper right column line 12 to p. 37 upper left column line 19 | p. 4 line 30 to p. 5 line 23, p. 29 line 1 to p. 45 line 25 p. 45 lines 33 to 40 and p. 65 lines 2 to 21 |
| High-boiling and/or low-boiling organic solvent | p. 137 lower left column line 9 to p. 144 upper right column last line | p. 35 lower right column line 14 to p. 36 upper left column line 4 from the bottom | p. 64 lines 1 to 51 |
| Method for dispersing additives for photograph | p. 144 lower left column line 1 to p. 146 upper right column line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 to p. 155 lower left column line 4 | — | — |
| Developing agent precursor | p. 155 lower left column line 5 to p. 155 lower right column line 2 | — | — |
| Compound releasing development inhibitor | p. 155 lower right column lines 3 to 9 | — | — |
| Base | p. 155 lower right column line 19 to p. 156 upper left column line 14 | p. 38 upper right column line 18 to p. 39 upper left column line 3 | p. 66 line 29 to p. 67 line 13 |
| Constitution of photosensitive layers | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower right column last line | p. 38 upper left column line 12 to upper right column line 7 | p. 66 lines 18 to 22 |
| Color-mix inhibitor | p. 185 upper left column line 1 to p. 188 lower right column line 3 | p. 36 upper right column lines 8 to 11 | p. 64 line 57 to p. 65 line 1 |
| Gradation controller | p. 188 lower right column lines 4 to 8 | — | — |
| Stain inhibitor | p. 188 lower right column line 9 to p. 193 lower right column line 10 | p. 37 upper left column last line to lower right column line 13 | p. 65 line 32 to p. 66 line 17 |
| Surface-active agent | p. 201 lower left column line 1 to p. 210 upper right column last line | p. 18 upper right column line 1 to p. 24 lower right column last line and p. 27 lower left column line 10 from the bottom to | — |

-continued

| Photographic constituting element, etc. | JP-A No. 215272/1987 | JP-A No. 33144/1990 | EP 0,355,660A2 |
|---|---|---|---|
| | | lower right column line 9 | |
| Fluorine-containing agent As Antistatic agent, coating aid, lubricant, adhesion inhibitor, or the like) | p. 210 lower left column line 1 to p. 222 lower left column line 5 | p. 25 upper left column line 1 to p. 27 lower right column line 9 | — |
| Binder (Hydrophilic colloid | p. 222 lower left column line 6 to p. 225 upper left column last line | p. 38 upper right column lines 8 to 18 | p. 66 lines 23 to 28 |
| Thickening agent | p. 225 upper right column line 1 to p. 227 upper right column line 2 | — | — |
| Antistatic agent | p. 227 upper right column line 3 to p. 230 upper left column line 1 | — | — |
| Polymer latex | p. 230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p. 10 upper right column line 5 | p. 39 upper left column line 4 to p. 42 upper left column last line | p. 67 line 14 to p. 69 line 28 |

Note:
In the cited part of JP-A No. 215272/1987, the contents of the descriptions in the amendment dated March 16, 1987, which appear in the last of the gazette, are included. Further, among the above-mentioned couplers, it is preferred to use so called short wavelength-type yellow coupler, described in JP-A Nos. 231451/1988, 123047/1988, 241547/1988, 173499/1989, 213648/1989, and 250944/1989, as a yellow coupler.

As cyan couplers, diphenylimidazole cyan couplers described in JP-A No. 33144/1990, 3-hydroxypyridine cyan couplers described in European Patent EP No. 0,333,185A2, cyclic active methylene cyan couplers described in JP-A 32260/1989, pyrrolopyrazole cyan couplers described in European EP No. 0,456,226A1, pyrroloimidazole cyan couplers described in European EP No. 0,484,909, and pyrrolotriazole cyan couplers described in European Patent EP Nos. 0,488,248 and 0,491,197A1, are preferably used. Among them, the pyrrolotriazole cyan couplers are particularly preferably used.

As magenta couplers to be used in the present invention, 5-pyrazoloazole magenta couplers of arylthio coupling split-off, described in International Publication WO Nos. 92/18901, 92/18902, and 92/18903, are preferable, because of the image preservability and less fluctuation of the image quality after processing.

Further, among pyrazoloazole magenta couplers used in the present invention, pyrazolotriazole couplers in which a secondary or tertiary alkyl group is directly bonded to the 2-, 3-, or 6-position of the pyrazolotriazole ring, as described in JP-A No. 65245/1986 and European Patent No. 571,959A; pyrazoloazole couplers containing a sulfonamido group in the molecule, as described in JP-A No. 65246/1986; pyrazoloazole couplers having an alkoxyphenylsulfonamido ballasting group, as described in JP-A No. 147254/1986; and pyrazoloazole couplers having an alkoxy group or an aryloxy group in the 6-position, as described in European Patent Nos. 226,849A and 294,785A, are preferably used in view, for example, of the hue, the image stability, and the color-forming property. Particularly 6-t-butyl-2-phenylene-type pyrazolotriazole couplers described in European Patent No. 571,959A are preferable.

As yellow couplers, known acylacetanilide couplers are preferably used, and above all, pivaloylacetanilide couplers having a halogen atom or an alkoxy group in the ortho-position of the anilide ring; acylacetanilide couplers in which the acyl group is a 1-position-substituted cycloalkanecarbonyl group, which are described, for example, in European Patent EP No. 0,447,969A, JP-A Nos. 107701/1993, and 113642/1993; and malondianilide couplers described, for example, in European Patent EP Nos. 0,482,552A and 0,524,540A, are preferably used.

When pivaloylacetanilide yellow couplers, acylacetanilide yellow couplers in which the acyl group is a 1-position-substituted cycloalkanecarbonyl group, or malondianilide yellow couplers react with the oxidation product of a developing agent to release a group, the coupling split-off group may be any of the above known groups; preferably the molecular weight of the coupling split-off group is 250 or less; and, for example, an N-benzyl-ethoxy-N-hydantoyl group can be used. More preferably, a split-off group having a molecular weight of 150 or less, such as a 4,4-dimethyl-N-hydantoyl group, can be used.

As the method of processing the color light-sensitive material of the present invention, besides the methods described in the above patent gazette, processing materials and processing methods described in JP-A No. 207250/1990, page 26, right lower column, line 1, to page 34, right upper column, line 9; and in JP-A No. 97355/1992, page 5, left upper column, line 17 to page 18, right lower column, line 20, are preferable.

According to the emulsified dispersion of the present invention, a silver halide color light-sensitive material that is improved and excellent in such a manner that the ultraviolet absorbing agent is prevented from being decomposed with light, and therefore the dye images do not cause color fading, can be provided with the long-term dispersion stability of the emulsified dispersion being excellent and without involving such a problem as defective coating.

EXAMPLES

Now, the present invention will be described in more detail with reference to Examples, but the present invention is not limited to them.

Example 1

50 g of Ultraviolet Absorbing Agent UV-A (a mixture of UV-24, UV-21, UV-39, and UV-36, in a weight ratio of 50/17/17/16) was dissolved in 27.5 g of the high-boiling organic solvent shown in Table 2; then 333 g of a 15% aqueous gelatin solution and 30 ml of a 10% aqueous solution of the above Surface-Active Agent W-7 were added to the solution, and the mixture was emulsified by a homogenizer (manufactured by Nihonseiki Co.) until the oil droplets in the emulsion had an average particle diameter of 0.12 μm. The average particle diameter of the oil droplets was measured by a Nanosizer, trade name, manufactured by British Coulter Co.

An aqueous gelatin solution was added to the emulsion, and the mixture was applied on a transparent base of a polyethylene perephthalate, so that the coating amounts would be as shown below. (As the hardener, 1-oxy-3,5-dichloro-s-triazine sodium salt was used.)

| Coating amount: | |
|---|---|
| Ultraviolet Absorbing Agent (UV-A) | 0.32 |
| Solvent (Solv-2) | 0.18 |
| Gelatin | 2.00 |

The coated product was named Sample 001.

The procedure for the preparation of Sample 001 was repeated, except that the high-boiling organic solvent was replaced as shown in Table 2, thereby producing Samples 002 to 005 and 009 to 012.

The procedure for the preparation of Sample 001 was repeated, except that the amount by weight (g/g) of the high-boiling organic solvent Solv-2 to the amount by weight of Ultraviolet Absorbing Agent A was each of 0.7 g, 0.8 g, and 1.0 g, to prepare respective emulsions, thereby producing Coated Samples 006, 007, and 008.

The ultraviolet spectral absorption density of these Samples by transmission was measured, and the value of the density of the absorption peak was read. When there were two peaks, the value of the peak on the longer wavelength side near 350 nm was read. Thereafter these Samples were respectively exposed to light by a xenon Fade-O-meter (trade name, manufactured by Atlas) for 21 days at 200,000 lux, then the ultraviolet spectral absorption was measured again, and the value of the density at the same wavelength as that of the absorption peak before the exposure was read.

The ratio of the density after the exposure to the density before the exposure was taken, to determine the remaining ratio of the ultraviolet-absorbing agent.

Remaining ratio=(density after exposure/density before exposure)×100 (%)

The viscosity and the specific water content of Samples 001 to 012 were measured in accordance with the methods described above.

From these values, $$X=24.7\times\log_{10}Y-11.7\times Z+43.7$$

was calculated. In the formula, Y and Z stand for, respectively, the viscosity of the high-boiling organic solvent in mPas at 25° C., and the specific water content of the high-boiling organic solvent in % by weight.

To evaluate the stability of the emulsions, the emulsion was kept for 30 days at 5° C. and was then dissolved for 2 days at 40° C.; the resulting emulsion was filtered through a filter having a pore size of 10 μmϕ, in an amount of 300 $1/m^2$, and the residue on the filter was observed. The stability was evaluated in such a way that when there was no residue, a rating 0 was given to it, and depending on the degree of the residue, integral ratings from 1 to 12 (maximum) were given to them, accordingly. The allowable range of the stability of the emulsion is 6 or below.

Organic solvent for comparison

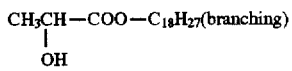

(Solv-A)

$C_{18}H_{37}$(branching) represents a 2-(1,3,3-trimethylbutyl)-5,7,7-trimethyl-1-octyl group.

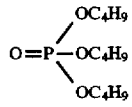

(Solv-B)

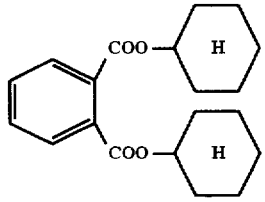

(Solv-C)

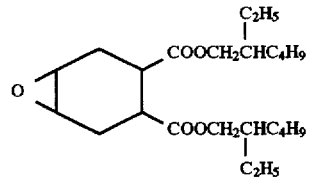

(Solv-D)

Table 2 shows the value of X of the high-boiling organic solvent used in Samples 001 to 012; the viscosity at 25° C. and 55% RH; the specific water content; the weight of the high-boiling organic solvent to the weight of the ultraviolet absorbing agent (g/g); the remaining ratio of the ultraviolet absorbing agent after exposure to light; and the stability of the emulsions. The remaining ratio of the ultraviolet absorbing agent in Samples 009 and 010, whose high-boiling organic solvents had X values of less than 85, was low, and the value of the stability of the emulsion of Sample 010, whose high-boiling organic solvent had an even low viscosity, was also low. In the cases of Sample 011, in which, as a high-boiling organic solvent, a phthalate was used, and Sample 012, in which an epoxy compound whose viscosity was less than 100 mPas was used, the stability of the emulsions was low. On the other hand, the emulsions of the present invention showed remarkable high stability, and a high remaining ratio of the ultraviolet-absorbing agent was kept even after the coating film was exposed to light.

Further, when the emulsified dispersion of the present invention was used, the coating property was excellent. Further, when the emulsified dispersion falling outside of the present invention (Comparison) was used, coating troubles, such as generation of seedings (granular structure) on the coated surface of the light-sensitive material, occurred. This coating trouble causes deterioration of the smoothness of the photograph surface and the color-forming properties.

TABLE 2

| Sample No. | High-boiling organic solvent | Value of X | Viscosity (mPas) | Specific water content (%) | Solv/UV (g/g) | Remaining ratio (%) | Stability | Remarks |
|---|---|---|---|---|---|---|---|---|
| 001 | Solv - 2 | 95 | 189 | 0.39 | 0.55 | 93 | 3 | This invention |
| 002 | Solv - 3 | 98 | 218 | 0.32 | " | 97 | 0 | " |
| 003 | Solv - 4 | 105 | 337 | 0.13 | " | 98 | 0 | " |
| 004 | Solv - 12 | 92 | 97 | 0.08 | " | 92 | 3 | " |
| 005 | Solv - 14 | 105 | 320 | 0.05 | " | 93 | 5 | " |
| 006 | Solv - 3 | 98 | 218 | 0.32 | 0.70 | 94 | 1 | " |
| 007 | Solv - 3 | 98 | 218 | 0.32 | 0.80 | 88 | 5 | " |
| 008 | Solv - 3 | 98 | 218 | 0.32 | 1.00 | 86 | 6 | " |
| 009 | Solv - A | 82 | 120 | 1.08 | 0.55 | 80 | 2 | Comparison |
| 010 | Solv - B | 4 | 35 | 6.64 | " | 19 | 12 | " |
| 011 | Solv - C | 113 | 784 | 0.18 | " | 94 | 9 | " |
| 012 | Solv - D | 90 | 89 | 0.03 | " | 88 | 10 | " |

Solv/UV represents the weight of the high-boiling organic solvent to the weight of the ultraviolet absorbing agent.

Example 2

A surface of a paper base, both surfaces of which had been laminated with a polyethylene, was subjected to corona discharge treatment; then it was provided with a gelatin undercoat layer containing a Surface-active Agent W-7, and it was coated with various photographic constitutional layers, to produce a multi-layer photographic color printing paper (021) having the layer constitution shown below. The coating liquids were prepared as follows.

(Preparation of Fifth-Layer Coating Liquid)

25.0 g of a cyan coupler (ExC), 21.0 g of Ultraviolet Absorbing Agent UV-B(a mixture of UV-21, UV-24, UV-36, and UV-39, in a weight ratio of 2/5/2/2), 21.0 g of a color image stabilizer (Cpd-1), 1.0 g of a color image stabilizer (Cpd-6), 1.0 g of a color image stabilizer (Cpd-8), 1.0 g of a color image stabilizer (Cpd-9), and 1.0 g of a color image stabilizer (Cpd-10) were dissolved in 1.0 g of a solvent (Solv-16), 19.0 g of a solvent (Solv-6), and 50 ml of ethyl acetate, and the resulting solution was emulsified and dispersed into 450 g of a 14% aqueous gelatin solution containing 1.7 g of the surface-active agent (W-7), to prepare an emulsified dispersion A. The grain size of the thus emulsified dispersion was measured by using a Coulter Sub-micron Grain Analyzer model N4, manufactured by Coulter Electronics Co., and the average grain size was 0.20 μm.

On the other hand, a silver chlorobromide emulsion C (cubes, a mixture of a large-size emulsion C having an average grain size of 0.50 μm, and a small-size emulsion C having an average grain size of 0.41 μm (1:4 in terms of mol of silver), the deviation coefficients of the grain size distributions being 0.09 and 0.11, respectively, and each emulsion having 0.8 mol % of silver bromide locally contained in part of the grain surface whose substrate was made up of silver chloride) was prepared. To the large-size emulsion C of this emulsion, had been added $5.0\times10^{-6}$ mol, per mol of silver, of each of red-sensitive sensitizing dyes G and H shown below, and to the small-size emulsion C of this emulsion, had been added $8.0\times10^{-6}$ mol, per mol of silver, of each of red-sensitive sensitizing dyes G and H shown below. The chemical ripening of this emulsion was optimally carried out with a sulfur sensitizer and a gold sensitizer being added. The above emulsified dispersion A and this silver chlorobromide emulsion C were mixed and dissolved, Cpd-18 was added to the resulting mixture, and a fifth-layer coating liquid was prepared so that it would have the composition shown below. The coating amount of the emulsion is in terms of silver.

In the similar way as the method of preparing of the fifth-layer coating liquid, coating liquids for the first layer to the seventh layer were prepared. As the gelatin hardeners for each layers, 1-oxy-3,5-dichloro-s-triazine sodium salt was used.

Further, to each layer, were added Cpd-11, Cpd-12, Cpd-13, and Cpd-14, so that the total amounts would be 15.0 mg/m$^2$, 6.0 mg/m$^2$, 5.0 mg/m$^2$, and 10.0 mg/m$^2$, respectively.

For the silver chlorobromide emulsion of each photosensitive emulsion layer, the following spectral sensitizing dyes were used.

(Blue-Sensitive Emulsion Layer)

Sensitizing dye A

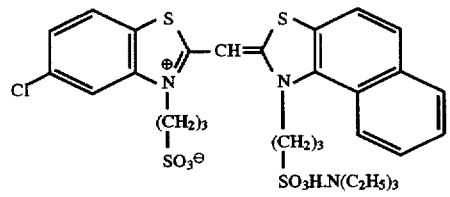

Sensitizing dye B

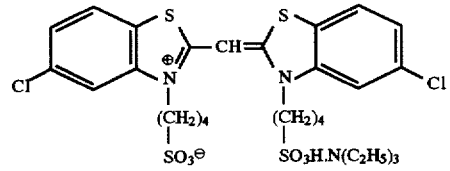

Sensitizing dye C

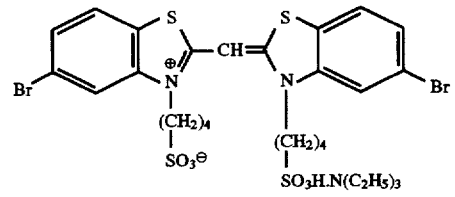

(Each was added to the large-size emulsion in an amount of $1.4\times10^{-4}$ mol per mol of the silver halide, and to the small-size emulsion in an amount of $1.7\times10^{-4}$ mol per mol of the silver halide.)

(Green-Sensitive Emulsion Layer)

Sensitizing dye D

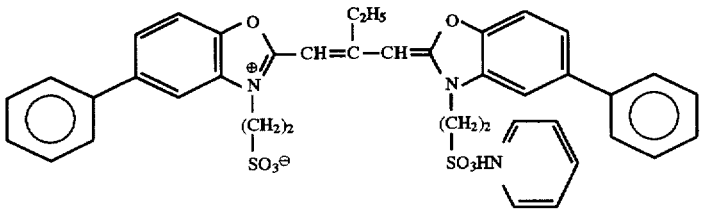

Sensitizing dye E

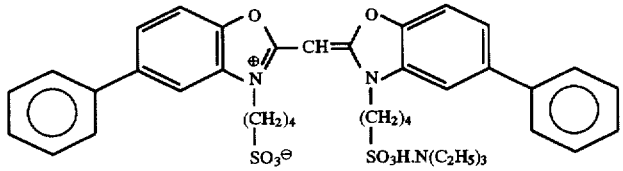

Sensitizing dye F

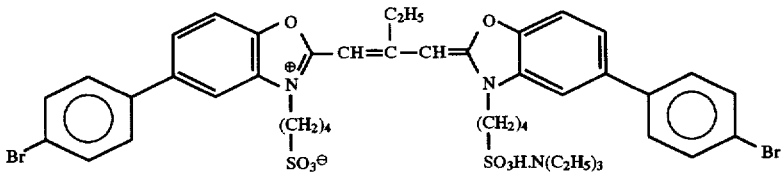

The sensitizing dye D was added to the large-size emulsion in an amount of $3.0\times10^{-4}$ mol per mol of the silver halide, and to the small-size emulsion in an amount of $3.6\times10^{-4}$ mol per mol of the silver halide; the sensitizing dye E was added to the large-size emulsion in an amount of $4.0\times10^{-5}$ mol per mol of the silver halide, and to the small-size emulsion in an amount of $7.0\times10^{-5}$ mol per mol of the silver halide; and the sensitizing dye F was added to the large-size emulsion in an amount of $2.0\times10^{-4}$ mol per mol of the silver halide, and to the small-size emulsion in an amount of $2.8\times10^{-4}$ mol per mol of the silver halide.

(Red-Sensitive Emulsion Layer)

Sensitizing dye G

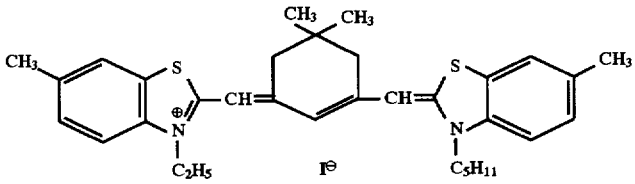

Sensitizing dye H

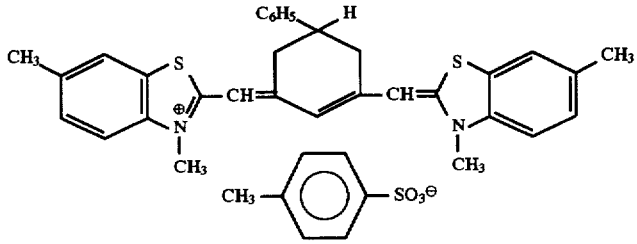

(Each was added to the large-size emulsion in an amount of $5.0\times10^{-5}$ mol per mol of the silver halide, and to the small-size emulsion in an amount of $8.0\times10^{-5}$ mol per mol of the silver halide.)

The following compound was added in an amount of $2.6\times10^{-3}$ mol per mol of the silver halide.

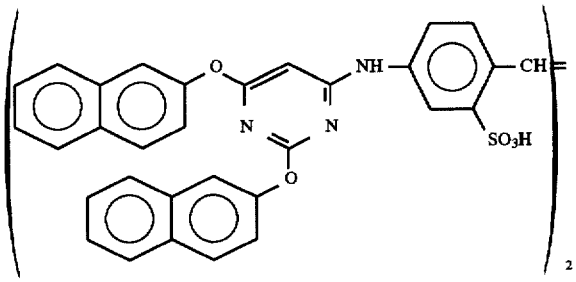

To the blue-sensitive emulsion layer, the green-sensitive emulsion layer, and the red-sensitive emulsion layer, was added 1-(5-methylureidophenyl)-5-mercaptotetrazole in amounts of $3.3\times10^{-4}$ mol, $1.0\times10^{-3}$ mol, and $5.9\times10^{-4}$ mol, respectively, per mol of the silver halide.

Further, to the second layer, the fourth layer, the sixth layer, and the seventh layer, were added the same compound, so that the amounts would be 0.2 mg/m$^2$, 0.2 mg/m$^2$, 0.6 mg/m$^2$, and 0.1 mg/m$^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, to prevent irradiation, the following dye was added to the emulsion layers (the coating amount is shown in parentheses).

(15 mg/m$^2$)

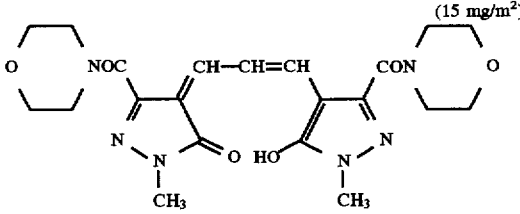

and (50 mg/m$^2$)

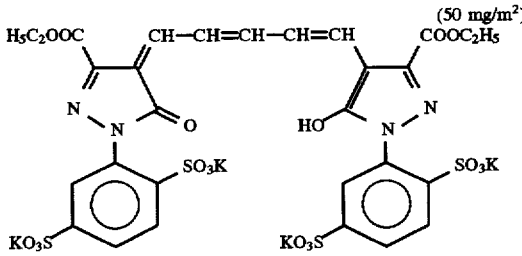

and

-continued (20 mg/m$^2$)

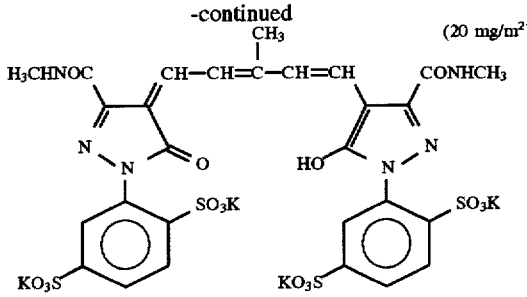

and (5 mg/m$^2$)

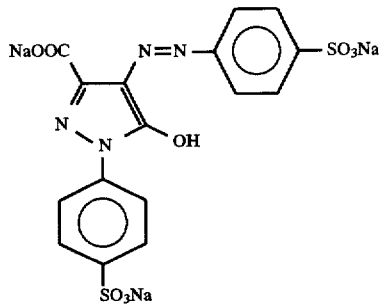

(Layer Constitution)

The layer constitution of each layer is shown below. The numbers show coating amounts (g/m$^2$). In the case of the silver halide emulsion, the coating amount is in terms of silver.

Base

Polyethylene-Laminated Paper

[The polyethylene on the first layer side contained a white pigment ($TiO_2$; in a content of 15% by weight) and a blue dye (ultramarine)]

First Layer (Blue-Sensitive Emulsion Layer)

Silver chlorobromide emulsion (cubes, a mixture of a large-size emulsion A having an average grain size of 0.88 μm, and a small-size emulsion A having an average grain size of 0.70 μm (3:7 in terms of mol of silver), the deviation coefficients of the grain size distributions being 0.08 and 0.10, respectively, and each emulsion having 0.3 mol % of silver bromide locally contained in part of the grain surface whose substrate was made up of silver chloride)

| | |
|---|---|
| | 0.27 |
| Gelatin | 1.40 |
| Yellow coupler (ExY) | 0.64 |
| Color image stabilizer (Cpd-1) | 0.08 |
| Color image stabilizer (Cpd-2) | 0.04 |
| Color image stabilizer (Cpd-3) | 0.09 |
| Color image stabilizer (Cpd-5) | 0.02 |
| Color image stabilizer (Cpd-16) | 0.01 |
| Solvent (Solv-16) | 0.22 |
| Second Layer (Color Mixing Inhibiting Layer) | |
| Gelatin | 1.44 |
| Color mixing inhibitor (Cpd-4) | 0.11 |
| Solvent (Solv-16) | 0.07 |
| Solvent (Solv-17) | 0.28 |
| Color image stabilizer (Cpd-7) | 0.17 |
| Solvent (Solv-22) | 0.01 |

Third Layer (Green-Sensitive Emulsion Layer)

A silver chlorobromide emulsion (cubes, a mixture of a large-size emulsion B having an average grain size of 0.55 μm, and a small-size emulsion B having an average grain size of 0.39 μm (1:3 in terms of mol of silver). The deviation coefficients of the grain size distributions were 0.10 and 0.08, respectively, and each emulsion had 0.8 mol % of AgBr contained locally in part of the grain surface whose substrate was made up of silver chloride.)

| | |
|---|---|
| | 0.13 |
| Gelatin | 1.32 |
| Magenta coupler (ExM) | 0.14 |
| Ultraviolet absorbing agent (UV-C) | 0.13 |
| Color image stabilizer (Cpd-2) | 0.01 |
| Color image stabilizer (Cpd-5) | 0.01 |
| Color image stabilizer (Cpd-6) | 0.01 |
| Color image stabilizer (Cpd-7) | 0.09 |
| Color image stabilizer (Cpd-8) | 0.03 |
| Color image stabilizer (Cpd-13) | 0.002 |
| Solvent (Solv-19) | 0.30 |
| Solvent (Solv-20) | 0.10 |
| Solvent (Solv-23) | 0.20 |

Note) UV-C represents a mixture of UV19, UV24, UV36, and UV39 in weight ratio of 3:4:2:2.

Fourth Layer (Color Mixing Inhibiting Layer)

| | |
|---|---|
| Gelatin | 0.82 |
| Color mixing inhibitor (Cpd-4) | 0.08 |
| Color image stabilizer (Cpd-7) | 0.12 |
| Solvent (Solv-16) | 0.05 |
| Solvent (Solv-17) | 0.20 |
| Solvent (Solv-22) | 0.007 |

Fifth Layer (Red-Sensitive Emulsion Layer)

A silver chlorobromide emulsion (cubes, a mixture of a large-size emulsion C having an average grain size of 0.50 μm, and a small-size emulsion C having an average grain size of 0.41 μm (1:4 in terms of mol of silver). The deviation coefficients of the grain size distributions were 0.09 and 0.11, respectively, and each emulsion had 0.8 mol % of silver bromide locally contained in part of the grain surface whose substrate was made up of silver chloride.)

| | |
|---|---|
| | 0.20 |
| Gelatin | 0.91 |
| Cyan coupler (ExC) | 0.25 |
| Ultraviolet absorbing agent (UV-D) | 0.21 |
| Color image stabilizer (Cpd-1) | 0.21 |
| Color image stabilizer (Cpd-6) | 0.01 |
| Color image stabilizer (Cpd-8) | 0.01 |
| Color image stabilizer (Cpd-9) | 0.01 |
| Color image stabilizer (Cpd-10) | 0.01 |
| COlor image stabilizer (Cpd-18) | 0.07 |
| Solvent (Solv-16) | 0.01 |
| Solvent (Solv-C) | 0.19 |

Note) UV-D represents a mixture of UV-21, UV-24, UV-36, and UV-39 in weight ratio of 2:5:2:2.

Sixth Layer (Ultraviolet Absorbing Agent Layer)

| | |
|---|---|
| Gelatin | 0.75 |
| Ultraviolet absorbing agent (UV-E) | 0.33 |
| Solvent (Solv-3) | 0.18 |

Note) UV-E represents a mixture of UV-24, UV-20, UV-18, UV-21, UV-36, and UV-39 in weight ratio of 6:3:2:2:2:2.

Seventh Layer (Protective Layer)

| | |
|---|---|
| Gelatin | 1.00 |
| Acryl-modified copolymer of polyvinyl alcohol (modification degree: 17%) | 0.04 |
| Liquid paraffin | 0.02 |
| Surface-active agent (Cpd-15) | 0.03 |

(ExY) Yellow coupler

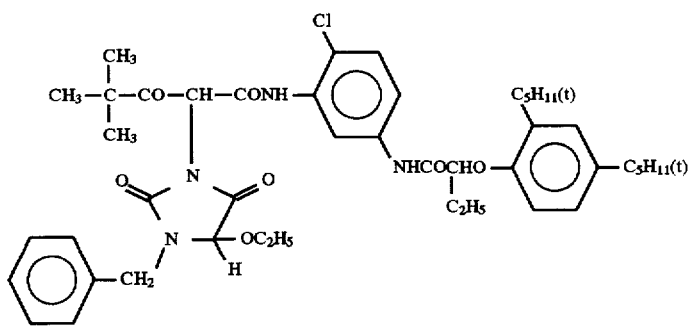

(ExY-1)

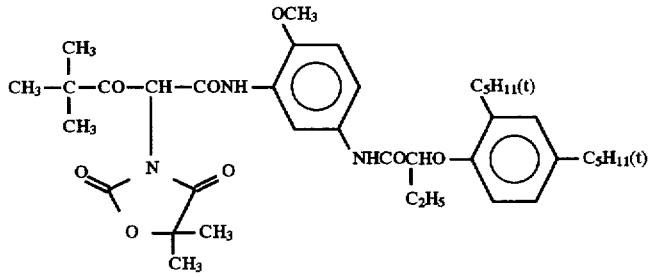

(ExY-2)

-continued
(ExY-3)
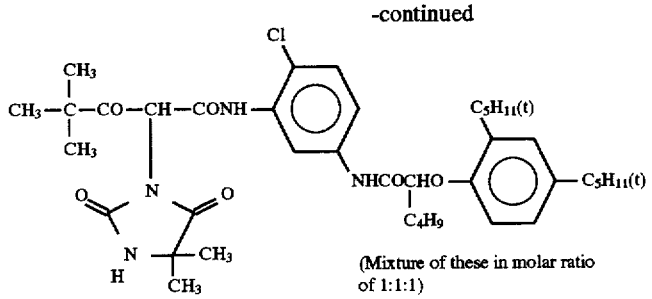
(Mixture of these in molar ratio of 1:1:1)
(ExM) Magenta coupler
(ExM-1)
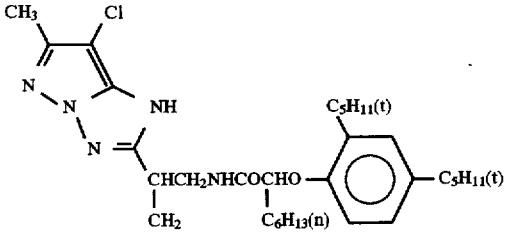
(ExM-2)
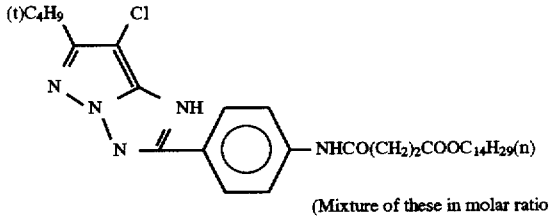
(Mixture of these in molar ratio of 1:5)
(ExC) Cyan coupler
(ExC-1)
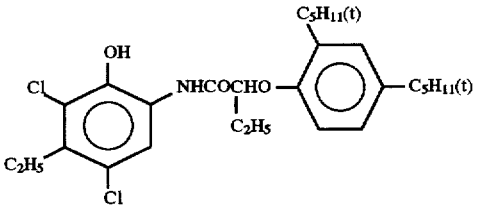
(ExC-2)
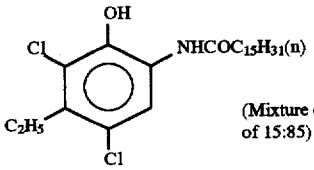
(Mixture of these in molar ratio of 15:85)
(Cpd-1) Color image stabilizer
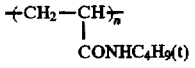
Average molecular weight 60,000
(Cpd-2) Color image stabilizer
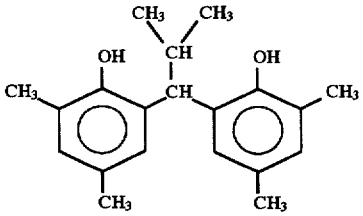

-continued
(Cpd-3) Color image stabilizer
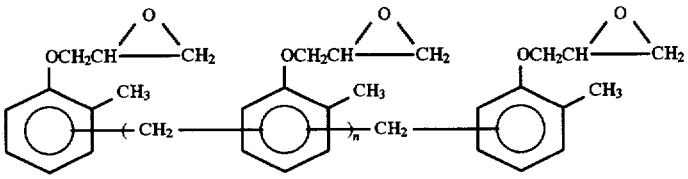
(n = 0~15, Average 8)
(Cpd-4) Color-mix inhibitor
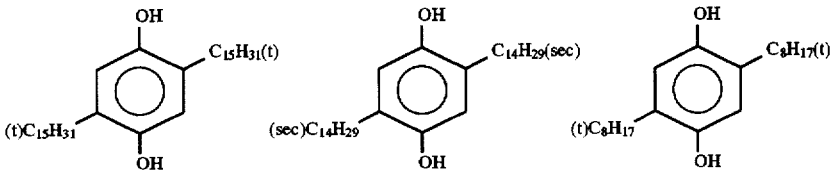
Mixture of these in weight ratio of 1:1:1
(Cpd-5) Color image stabilizer
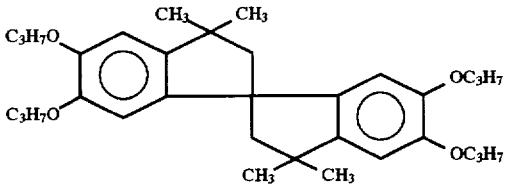
(Cpd-6) Color image stabilizer
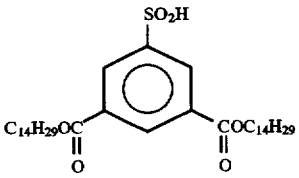
(Cpd-7) Color image stabilizer
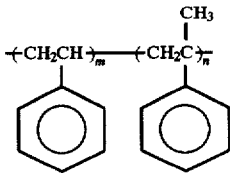
Number-average
molecular weight 600
m/n = 10/90
(Cpd-8) Color image stabilizer
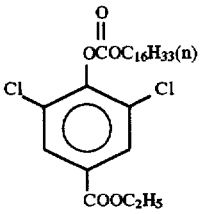

-continued
(Cpd-9) Color image stabilizer
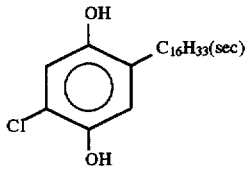
(Cpd-10) Color image stabilizer
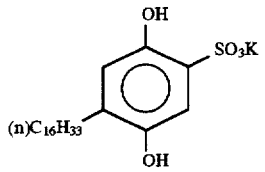
(Cpd-11) Antiseptic
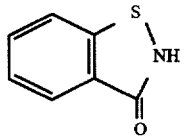
(Cpd-12) Antiseptic
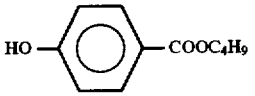
(Cpd-13) Antiseptic
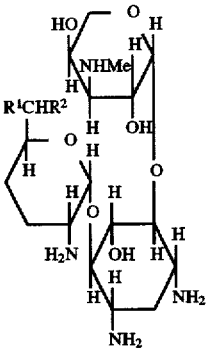
| | $R^1$ | $R^2$ |
|---|---|---|
| a | —Me | —NHMe |
| b | —Me | —$NH_2$ |
| c | —H | —$NH_2$ |
| d | —H | —NHMe |
Mixture of a, b, c, d in weight ratio of 1:1:1:1
(Cpd-14) Antiseptic
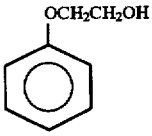
(Cpd-15) Surface-active agent
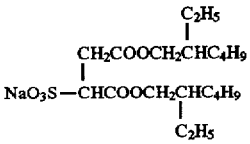
(1)
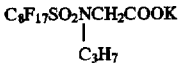
(2)

-continued
(3)
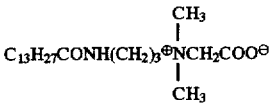
Mixture of (1), (2), (3) in weight ratio of 3:1:3
(Cpd-16) Color image stabilizer
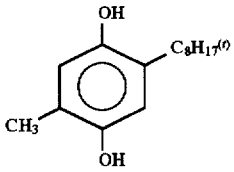
(Cpd-17) Color image stabilizer
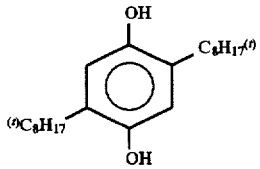
(Cpd-18) Color image stabilizer
Copolymer of methacrylic acid/n-butyl acrylate (weight ratio at 40/60)
(Solv-16) Solvent
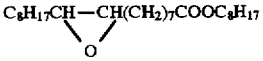
(Solv-17) Solvent
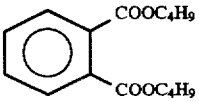
(Solv-18) Solvent
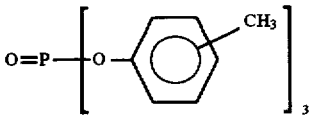
(Solv-19) Solvent
$O{=}P{+}O{-}C_6H_{13}(n)]_3$
(Solv-20) Solvent
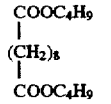
(Solv-21) Solvent
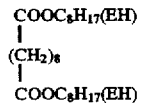

-continued (Solv-22) Solvent

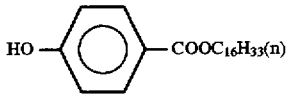

(Solv-23) Solvent

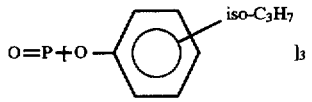

The procedure for the preparation of Sample 021 was repeated, except that, in Sample 021 prepared in the above manner, the high-boiling organic solvent was replaced by the high-boiling organic solvent shown in Table 3, in an equal weight ratio to the total weight of the ultraviolet absorbing agent in the sixth layer (ultraviolet absorbing agent layer), thereby producing Samples 022 to 032.

The above Samples 021 to 032 were exposed to light by using a sensitometer (FWH type, manufactured by Fuji Photo Film Co., Ltd.; the color temperature of the light source, 3,200° K.), so that about 35% of the amount of coated silver might be developed to give gray.

A quantity of 200 $m^2$ of the above Samples was processed continuously using a paper processor in the following processing steps with solutions having the following processing solution compositions.

| Processing step | Temperature | Time | Replenisher* | Tank volume |
|---|---|---|---|---|
| Color Development | 35° C. | 45 sec | 161 ml | 10 liter |
| Bleach-fix | 35° C. | 45 sec | 218 ml | 10 liter |
| Rinse (1) | 35° C. | 30 sec | — | 5 liter |
| Rinse (2) | 35° C. | 30 sec | — | 5 liter |
| Rinse (3) | 35° C. | 30 sec | 360 ml | 5 liter |
| Drying | 80° C. | 60 sec | | |

*Replenishing amount per $m^2$ of the light-sensitive material
(Rinsing was conducted in a 3 tanks counter current system from (3) to (1).)

The composition of each processing solution are as follows.

(Color Developer)

| | Tank liquid | Replenisher |
|---|---|---|
| Water | 800 ml | 800 ml |
| Ethylenediaminetetraacetic acid | 3.0 g | 3.0 g |
| 4,5-dihydroxybenzene-1,3-disulfonic acid disodium salt | 0.5 g | 0.5 g |
| Triethanolamine | 12.0 g | 12.0 g |
| Potassium chloride | 2.5 g | — |
| Potassium bromide | 0.01 g | — |
| Potassium carbonate | 27.0 g | 27.0 g |
| Whitening agent (WHITEX 4, trade name: manufactured by Sumitomo Kagaku Co.) | 1.0 g | 2.5 g |
| Sodium sulfite | 0.1 g | 0.2 g |
| Disodium N,N-bis (sulfonatoethyl) hydroxylamine | 5.0 g | 8.0 g |
| N-ethyl-N-(β-methanesulfonamidoethyl)-3-methyl-4-amioaniline · 3/2 sulfuric acid · 1 hydrate | 5.0 g | 7.1 g |

-continued (Color Developer)

| | Tank liquid | Replenisher |
|---|---|---|
| Water to make | 1,000 ml | 1,000 ml |
| pH (at 25° C., adjusted with potassium hydroxide and sulfuric acid) | 10.05 | 10.45 |
| (Bleach-fix Liquid)(tank liquid and replenisher were the same) | | |
| Water | 600 ml | |
| Ammonium thiosulfate (700 g/liter) | 100 ml | |
| Ammonium sulfite | 40 g | |
| Ethylenediaminetetraacetic acid iron(III) ammonium salt | 55 g | |
| Ethylenediaminetetraacetic acid | 5 g | |
| Ammonium bromide | 40 g | |
| Sulfur (67%) | 30 g | |
| Water to make | 1,000 ml | |
| pH (at 25° C., adjusted with acetic acid and aqueous ammonia) | 5.8 | |
| (Rinse Liquid)(tank liquid and replenisher were the same) | | |
| Sodium chlorinated-isocyanurate | 0.02 g | |
| Deionized water (conductivity: 5 μS/cm or below) | 1,000 ml | |
| pH | 6.5 | |

The Samples thus obtained were subjected to a fading test for 20 days at 100,000 lux by a xenon Fade-O-meter, and the light fastness was evaluated by finding the remaining ratio (%) of the yellow (Y), magenta (M), and cyan (C) dye images, with the initial density being 2.00. The results are shown in Table 3.

TABLE 3

| Sample No. | High-boiling organic solvent | Solv/UV (g/g) | Remaining amount of dye (%) Y | M | C | Remarks |
|---|---|---|---|---|---|---|
| 021 | Solv-2 | 0.55 | 77 | 76 | 77 | This invention |
| 022 | Solv-3 | " | 78 | 78 | 77 | " |
| 023 | Solv-4 | " | 79 | 79 | 78 | " |
| 024 | Solv-12 | " | 75 | 75 | 75 | " |
| 025 | Solv-14 | " | 75 | 73 | 75 | " |
| 026 | Solv-3 | 0.70 | 76 | 76 | 77 | " |
| 027 | Solv-3 | 0.80 | 72 | 73 | 72 | " |
| 028 | Solv-3 | 1.00 | 70 | 72 | 71 | " |
| 029 | Solv-A | 0.55 | 64 | 65 | 65 | Comparison |
| 030 | Solv-B | " | 53 | 54 | 52 | " |
| 031 | Solv-C | " | 72 | 73 | 72 | " |
| 032 | Solv-D | " | 70 | 71 | 69 | " |

Solv/UV represents the weight of the high-boiling organic solvent to the weight of the ultraviolet absorbing agent.

As is apparent from the results in Table 3, in the cases of Sample Nos. 029 and 030, whose high-boiling organic solvents had X values of less than 85, the fading, due to light, of the dye images produced from the couplers was conspicuously large. Further, as shown in Example 1, in the cases of Sample No. 031, in which, as a high-boiling organic solvent, a phthalate was used, and Sample No. 032, in which a compound having an epoxy group whose viscosity was less than 100 mPas was used, the stability of the emulsions was low. On the other hand, in comparison with comparative multi-layer color light-sensitive materials, in the multi-layer color light-sensitive materials made from emulsions of the present invention, the fading, due to light, of the dye images produced from the couplers was improved, and even after exposure to light for a long period of time, the dye images remained well balanced.

Further, when the emulsified dispersion of the present invention was used, the coating property was excellent. Further, when the emulsified dispersion falling outside of the present invention (Comparison) was used, coating troubles, such as generation of seedings (granular structure) on the coated surface of the light-sensitive material, occurred. This coating trouble causes deterioration of the smoothness of the photograph surface and the color-forming properties.

Example 3

The preparation of Samples 001 to 012 in Example 1 was repeated, except that the ultraviolet absorbing agent was changed to an ultraviolet absorbing agent of a mixture of UV-24/UV-19/UV-21/UV-39/UV36 in a weight ratio of 42/20/12/14/14, and that the high-boiling organic solvents and the weight of the high-boiling organic solvent to the weight of the ultraviolet-absorbing agent (g/g) were changed as shown in Table 4, thereby producing Samples 041 to 052. They were evaluated in the same way as in Example 1. Further, similarly to Example 2, in Samples 041 to 052, coating was carried out in such a way that the coating amount of the ultraviolet absorbing agent was made equal in the sixth layer (ultraviolet absorbing agent layer) of the multi-layer color light-sensitive material, and the evaluation was carried out in the same way as in Example 2.

The results are shown in Table 4.

TABLE 4

| Sample No. | High-boiling organic solvent | Value of X | Viscosity (mPas) | Specific water content (%) | Solv/UV (g/g) | Stability | Remaining amount of dye (%) Y | M | C | Remarks |
|---|---|---|---|---|---|---|---|---|---|---|
| 041 | Solv - 2 | 95 | 189 | 0.39 | 0.55 | 2 | 77 | 76 | 76 | This invention |
| 042 | Solv - 3 | 98 | 218 | 0.32 | " | 0 | 78 | 77 | 78 | " |
| 043 | Solv - 4 | 105 | 337 | 0.13 | " | 0 | 78 | 78 | 79 | " |
| 044 | Solv - 5 | 94 | 123 | 0.10 | " | 3 | 75 | 74 | 74 | " |
| 045 | Solv - 14 | 86 | 62 | 0.05 | " | 5 | 71 | 72 | 72 | " |
| 046 | Solv - 4 | 95 | 189 | 0.13 | 0.70 | 0 | 76 | 77 | 76 | " |
| 047 | Solv - 4 | 95 | 189 | 0.13 | 0.80 | 4 | 70 | 70 | 71 | " |
| 048 | Solv - 4 | 95 | 189 | 0.13 | 1.00 | 5 | 68 | 69 | 68 | " |
| 049 | Solv - A | 82 | 120 | 1.08 | 0.55 | 2 | 61 | 62 | 63 | Comparison |
| 050 | Solv - B | 4 | 35 | 6.64 | " | 10 | 53 | 53 | 52 | " |
| 051 | Solv - C | 113 | 784 | 0.18 | " | 8 | 64 | 66 | 65 | " |
| 052 | Solv - D | 90 | 89 | 0.03 | " | 10 | 62 | 63 | 62 | " |

Solv/UV represents the weight of the high-boiling organic solvent to the weight of the ultraviolet absorbing agent.

As is apparent from the results of Table 4, even if different ultraviolet absorbing agents are used, in the multi-layer color light-sensitive material produced from the emulsion of the present invention, the fading, due to light, of the dye images produced from the couplers is improved; the dye images, even if exposed to light for a long period of time, remain well balanced; and the emulsion has high stability.

Further, when the emulsified dispersion of the present invention was used, the coating property was excellent. Further, when the emulsified dispersion falling outside of the present invention (Comparison) was used, coating troubles, such as generation of seedings (granular structure) on the coated surface of the light-sensitive material, occurred. This coating trouble causes deterioration of the smoothness of the photograph surface and the color-forming properties.

Example 4

50 g of Ultraviolet Absorbing Agent UV-A (a mixture of UV-24, UV-21, UV-39, and UV-36, in a weight ratio of 50/17/17/16) was dissolved in 27.5 g of ethyl acetate; then 333 g of a 15% aqueous gelatin solution and 30 ml of a 10% aqueous solution of the above Surface-Active Agent W-7 were added to the solution, and the mixture was emulsified by a homogenizer until the oil droplets in the emulsion had an average particle diameter of 0.10 μm. On the other hand, 27.5 g of the high-boiling organic solvent shown in Table 5, 120 g of a 15% aqueous gelatin solution, and 30 ml of a 10% aqueous solution of the Surface-Active Agent W-7 were mixed together, to prepare an emulsion having the average particle diameter of 0.07 μm, according to the above method.

The coating of Example 2 was repeated, except that the ultraviolet-absorbing agent in the sixth layer (ultraviolet-absorbing agent layer) of the multi-layer color light-sensitive material of Example 2 was replaced with an emulsion prepared by mixing the above emulsion of the ultraviolet-absorbing agent and the above emulsion of the high-boiling organic solvent at 45° C., so that the coating amounts might be equal. The evaluation was carried out in the same way as in Example 2. The results are shown in Table 5.

TABLE 5

| Sample No. | High-boiling organic solvent | Value of X | Viscosity (mPas) | Specific water content (%) | Solv/UV (g/g) | Remaining amount of dye (%) Y | M | C | Remarks |
|---|---|---|---|---|---|---|---|---|---|
| 061 | Solv - 2 | 95 | 189 | 0.39 | 0.55 | 76 | 75 | 76 | This invention |
| 062 | Solv - 3 | 98 | 218 | 0.32 | " | 77 | 77 | 78 | " |
| 063 | Solv - 4 | 105 | 337 | 0.13 | " | 78 | 76 | 78 | " |
| 064 | Solv - 5 | 94 | 123 | 0.10 | " | 73 | 74 | 72 | " |
| 065 | Solv - 14 | 86 | 62 | 0.05 | " | 73 | 72 | 72 | " |
| 066 | Solv - A | 82 | 120 | 1.08 | " | 61 | 62 | 59 | Comparison |
| 067 | Solv - B | 4 | 35 | 6.64 | " | 53 | 53 | 52 | " |
| 068 | Solv - C | 113 | 784 | 0.18 | " | 62 | 64 | 64 | " |
| 069 | Solv - D | 90 | 89 | 0.03 | " | 61 | 63 | 62 | " |

Solv/UV represents the weight of the high-boiling organic solvent to the weight of the ultraviolet absorbing agent.

As is apparent from the results in Table 5, the multi-layer color light-sensitive material prepared by adding a high-boiling organic solvent according to the present invention to an emulsion of an ultraviolet-absorbing agent was improved in color fading (discoloration) of the dye image due to light.

Further, when the emulsified dispersion of the present invention was used, the coating property was excellent. Further, when the emulsified dispersion falling outside of the present invention (Comparison) was used, coating troubles, such as generation of seedings (granular structure) on the coated surface of the light-sensitive material, occurred. This coating trouble causes deterioration of the smoothness of the photograph surface and the color-forming properties.

Having described our invention as related to the present embodiments, it is our intention that the invention not be limited by any of the details of the description, unless otherwise specified, but rather be construed broadly within its spirit and scope as set out in the accompanying claims.

What we claim is:

1. An emulsified dispersion, in which at least one compound represented by formula (1) dissolved in an organic solvent comprising at least one high-boiling organic sovlent satisfying the condition X≧85 in formula (A) is emulsified in a water medium; with the proviso that phthalate and compounds having an epoxy group are excluded from said high-boiling organic solvent:

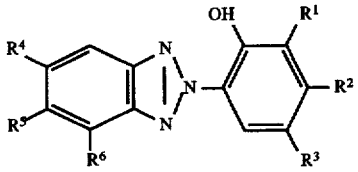

wherein $R^1$, $R^2$, $R^3$, $R^4$, $R^5$, and $R^6$, which are the same or different, each represent a hydrogen atom, a halogen atom, a nitro group, a hydroxyl group, an alkyl group, an alkoxy group, an aryl group, an aryloxy group, an acylamino group, a carbamoyl group, or a sulfo group and $R^5$ and $R^6$ may bond together to form a 6-membered ring, formula (A)

$$X=24.7\times Log_{10}Y-11.7\times Z+43.7$$

wherein Y and Z stand for, respectively, the viscosity of the high-boiling organic solvent in mPaS at 25° C., and the specific water content of the high-boiling organic solvent in % by weight, wherein the high-boiling organic solvent is selected from the following:

trimellitates represented by formula (3):

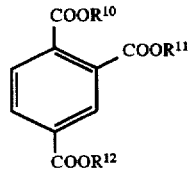

wherein $R^{10}$, $R^{11}$, and $R^{12}$ each independently represent an aliphatic group or an aryl group, and chlorinated paraffins represented by formula (5):

formula (5)

$$C_dH_{(2d-e+2)}Cl_e,$$

wherein d and e are each a positive integer with e≦2d+2.

2. The emulsified dispersion as claimed in claim 1, wherein the viscosity of the high-boiling organic solvent at 25° C. is 100 mPas or more but 6,000 mPas or less.

3. The emulsified dispersion as claimed in claim 1, wherein the high-boiling organic solvent is the trimellitate represented by formula (3), and wherein $R^{10}$, $R^{11}$, and $R^{12}$ each represent an alkyl group, and the total number of carbon atoms in the alkyl moieties is 24 to 36.

4. The emulsified dispersion as claimed in claim 1, wherein the water medium is an aqueous gelatin solution.

5. The emulsified dispersion as claimed in claim 1, wherein the weight ratio of the oil component to the water component is from 2 to 1/100.

6. The emulsified dispersion as claimed in claim 1, wherein the specific water content of the high-boiling organic solvent is 3% by weight or less.

7. The emulsified dispersion as claimed in claim 1, wherein the amount of the high-boiling organic solvent to be used is in the range of from 0.1 to 10 by weight ratio to the compound represented by formula (1).

8. A silver halide color photographic light-sensitive material, which contains, in at least one layer of light-sensitive silver halide emulsion layer and non-light-sensitive hydrophilic colloid layer applied on a base, at least one compound represented by formula (1) and at least one high-boiling organic solvent satisfying the condition X≧85 in formula (A); with the proviso that phthalates and compounds having an epoxy group are excluded from said high-boiling organic solvent:

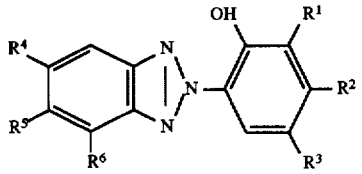

wherein $R^1$, $R^2$, $R^3$, $R^4$, $R^5$, and $R^6$, which are the same or different, each represent a hydrogen atom, a halogen atom, a nitro group, a hydroxyl group, an alkyl group, an alkoxy group, an aryl group, an aryloxy group, an acylamino group, a carbamoyl group, or a sulfo group, and $R^5$ and $R^6$ may bond together to form a 6-membered ring, formula (A)

$$X=24.7\times Log_{10}Y-11.7\times Z+43.7$$

wherein Y and Z stand for, respectively, the viscosity of the high-boiling organic solvent in mPas at 25° C., and the specific water content of the high-boiling organic solvent in % by weight, wherein the high-boiling organic solvent is selected from the following:

trimellitates represented by formula (3):

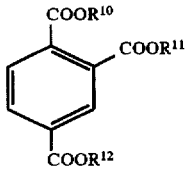

wherein $R^{10}$, $R^{11}$, and $R^2$ each independently represent an aliphatic group or an aryl group, and chlorinated paraffins represented by formula (5):

formula (5)

$$C_dH_{(2d-e+2)}Cl_e$$

wherein d and e are each a positive integer with $e \leqq 2d+2$, wherein the at least one compound represented by formula (1) and the at least one high-boiling organic solvent are present in the same layer.

9. The silver halide color photographic light-sensitive material as claimed in claim 8, wherein the viscosity of the high-boiling organic solvent at 25° C. is 100 mPas or more but 6,000 mPas or less.

10. The silver halide color photographic light-sensitive material as claimed in claim 8, wherein the high-boiling organic solvent is the trimellitate represented by formula (3), and wherein $R^{10}$, $R^{11}$, and $R^{12}$ each represent an alkyl group, and the total number of carbon atoms in the alkyl moieties is 24 to 36.

11. The silver halide color photographic light-sensitive material as claimed in claim 8, wherein the layer containing the compound of formula (1) and the high-boiling organic solvent comprises one or more light-sensitive silver halide emulsion layers and/or one or more non-light-sensitive hydrophilic colloid layers.

12. The silver halide color photographic light-sensitive material as claimed in claim 8, wherein the specific water content of the high-boiling organic solvent is 3% by weight or less.

13. The silver halide color photographic light-sensitive material as claimed in claim 8, wherein the amount of the high-boiling organic solvent to be used is in the range of from 0.1 to 10 by weight ratio to the compound represented by formula (1).

14. The silver halide color photographic light-sensitive material as claimed in claim 8, wherein the light-sensitive silver halide emulsion layer comprises a silver chloride or a silver chlorobromide emulsion having a silver chloride content of 90 mol % or more.

* * * * *